United States Patent [19]

Würfel

[11] Patent Number: 4,487,684

[45] Date of Patent: Dec. 11, 1984

[54] PROCESS FOR HYDROGENATION OF COAL

[75] Inventor: Helmut Würfel, Blieskastel, Fed. Rep. of Germany

[73] Assignee: Gfk Gesellschaft für Kohleverflüssigung mbH, Saarbruecken, Fed. Rep. of Germany

[21] Appl. No.: 511,165

[22] PCT Filed: Oct. 7, 1982

[86] PCT No.: PCT/DE82/00199

§ 371 Date: Jun. 8, 1983

§ 102(e) Date: Jun. 8, 1983

[87] PCT Pub. No.: WO83/01456

PCT Pub. Date: Apr. 28, 1983

[30] Foreign Application Priority Data

Oct. 17, 1981 [DE] Fed. Rep. of Germany ..... 3141380

[51] Int. Cl.[3] ..... C10G 1/06

[52] U.S. Cl. ..... 208/10

[58] Field of Search ..... 208/10

[56] References Cited

U.S. PATENT DOCUMENTS 4,152,244 5/1979 Raichle et al. ..... 208/10 X
4,189,375 2/1980 Kirby et al. ..... 208/10 X
4,222,844 9/1980 Nizawoff ..... 208/10 X

FOREIGN PATENT DOCUMENTS 2646605 4/1978 Fed. Rep. of Germany ..... 208/10
2945352 5/1981 Fed. Rep. of Germany ..... 208/10
WO82/01715 5/1982 PCT Int'l Appl. ..... 208/10
2058125 4/1981 United Kingdom ..... 208/10

*Primary Examiner*—Carl F. Dees
*Assistant Examiner*—William G. Wright

[57] ABSTRACT

In a process for hydrogenizing coal in which finely ground coal, which is mixed with grinding oil, is pumped to pressure, heated to the temperature at which hydrogenation is initiated and then hydrogenated with hydrogen in a reactor in the presence of a substance which acts as a catalyst, the introduction of part of the heat required for heating is effected in a mixer by direct heat exchange with hot product vapors. The remainder of the heat required is fed to the coal slurry by direct heat exchange with an additional hot gas stream which preferably consists of hydrogen and which is brought into contact with the coal slurry in the region of the mixer, the gas stream finally being separated from the slurry along with the uncondensed product vapors and the gases and vapors driven out of the heated coal slurry.

7 Claims, 1 Drawing Figure

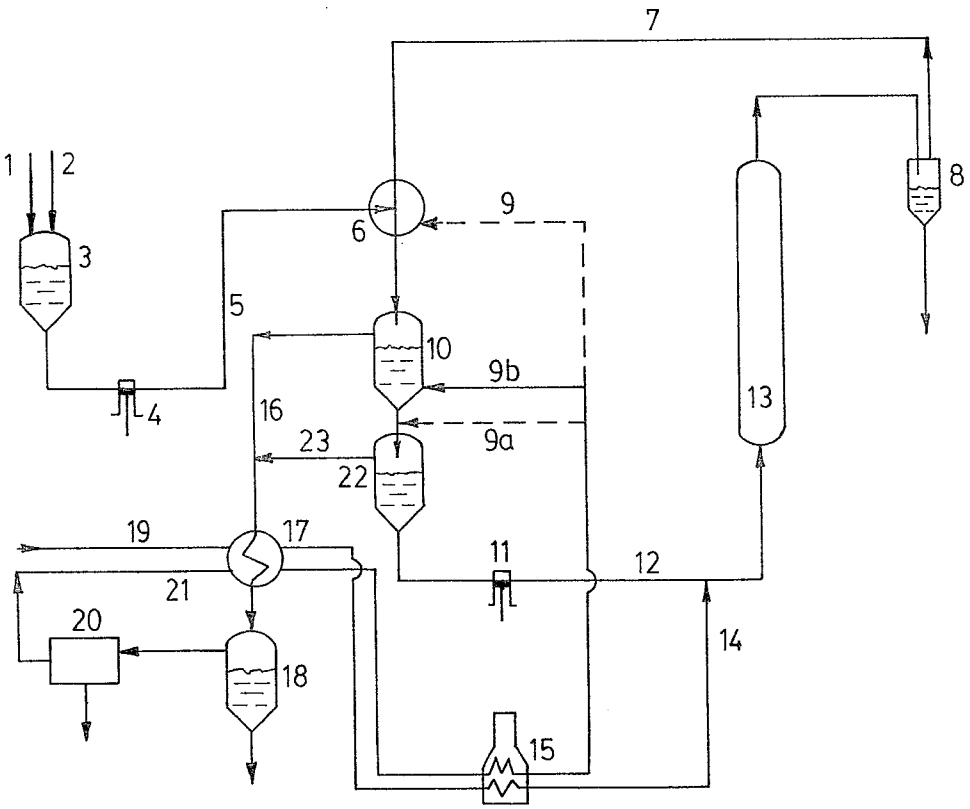
1
2
3
4
5
6
7
8
9
9a
9b
10
11
12
13
14
15
16
17
18
19
20
21
22
23

PROCESS FOR HYDROGENATION OF COAL

The invention relates to a process for hydrogenizing coal whereby the finely ground coal is pumped under pressure, heated to the temperature at which hydrogenation is initiated and hydrogenized with hydrogen in a reaction zone in the presence of a substance which acts as a catalyst, the process being such that at least part of the heat required for the heating process is fed to the coal in a mixing stage by direct heat-exchange with hot product vapors.

German Pat. DT-PS No. 669 660 discloses a process for producing liquid hydrocarbon oils by hydrogenizing solid carbon-containing substances, the process being such that vaporous and gaseous products are brought into intimate contact with starting materials in the form of a slurry. The aim of this process is to bind the acidic substances entrained in the vaporous and gaseous products by the alkaline constituents contained in the solid starting materials, whereby, due to the neutralization of their alkaline constituents, the starting materials should be simultaneously put into a more suitable form for the pressure-hydrogenizing process.

At the same time, part of the low boiling point constituents contained in the coal slurry can be separated from the latter, while the high boiling point constituents of the hot product vapors condense and arrive again in the hydrogenizing reactor along with the coal slurry.

The heating of the coal slurry which occurs as a result of mixing the said slurry with the vapor and gaseous products is not always sufficient to initiate the hydrogenizing reactions. It then becomes necessary additionally to heat the coal slurry to the reaction-initiating temperature in a separately heated heat exchanger.

However, heating the coal slurry in a heat exchanger is found to be extremely difficult because, due to the viscosity of the slurry, it is impossible to obtain uniform loading of the heat exchanger surfaces. In addition, at the high temperatures present in the heat exchanger, the coal suspended in the slurry swells. This leads to an additional increase in the viscosity and, in turn, to a pulsating throughput of the coal slurry through the heat exchanger with concomitant pressure surges and high material wear.

In addition, the gases and vapors, which are first formed during the further heating of the coal slurry in the heat exchanger, arrive in the reactor, thus leading, in particular, to a dilution of the hydrogen in the reactor and, because of the space required to accommodate these gases and vapors, the result is a worsening in the degree of filling of the reactor with coal slurry.

The gases and vapors entrained by the coal slurry must be heated, along with the latter, to the temperature of the initiation of the hydrogenation resulting in an additional heat requirement.

Low boiling point oils, which arrive with the coal slurry in the reactor where they vaporize on the further increase of the temperature, do not, on account of their vapor state, participate in the actual coal hydrogenizing process but undergo, instead, a further cracking on account of the high temperature and whereby, with the consumption of hydrogen, additional undesirable compounds are produced.

The basic objective of this invention is to provide a process of the above-mentioned type which obviates these drawbacks and which ensures better heating as well as the optimum conditioning of the coal slurry to be hydrogenated.

This objective is attained, in accordance with the invention, by bringing the coal slurry in the mixer region in contact with an additional stream of hot gas.

With the process of the invention, it is possible to dispense entirely with the use of heat exchangers to heat the coal slurry, and thus avoid the problems associated with them. Furthermore, heating the gas stream can be effected in the usual way in a heat exchanger or in a furnace and gives rise to no difficulties.

Both the gas stream and the uncondensed part of the product vapors, along with the gases and vapors driven out of the coal slurry, are separated again from the slurry before the latter is conveyed to the hydrogenizing reactor, as a result of which the hydrogenizing process is advantageously affected.

The hot stream of gas can be admixed with the coal slurry in a mixer where the product vapors mix with the coal slurry, or immediately beyond it, and then are separated from the slurry together with the portion of the product vapors which did not condense during the heat exchange, and from the gases and vapors driven out of the heated coal slurry in the mixer.

However, it can be quite appropriate for the stream of hot gas to be admixed with the coal slurry following the mixer containing the hot product vapors and the coal slurry, the admixture being effected after separating-out the uncondensed portion of the product vapors together with the gases and vapors driven out of the coal slurry in the mixer, after which the hot gas stream is again separated from the mixture together with the gases and vapors additionally driven out of the coal slurry.

An especially advantageous and simple solution is attained when the hot gas stream is admixed with the coal slurry at the bottom of a separator which is connected to the outlet side of the mixer of the product vapors with the coal slurry. In the process, the gas stream flows through the coal slurry in counter-current and is drawn off at the top of the separator along with the uncondensed portion of the product vapors and the gases and vapors driven out of the heated coal slurry.

Because the gas stream flows through the coal slurry in counter-current, a very intense heat and mass exchange takes place as a result of which, especially on account of the stripping effect of the fed-in gas stream, the light oils contained in the coal slurry evaporated. In particular, the stripping effect of the fed-in gas stream is sustained, so that all the gases and vapors carried along in the heated coal slurry are almost completely entrained by the gas stream and separated from the coal slurry, and are consequently not fed into the reactor.

In order to ensure, as complete as possible, a removal of the low boiling point oils contained in the heated coal slurry, the coal slurry is preferably subjected to an adequate heating, for example, solely by product vapors fed into the mixer in the described manner with a gas stream whose temperature corresponds to that of the heated coal slurry or which temperature is slightly above that of the coal slurry.

In order to be able to re-use the gas stream to heat the coal slurry or to drive out the low boiling point oils contained in said slurry, the entrained uncondensed product vapors are separated from the gas stream drawn out of the coal slurry and from the gases and vapors driven out of the heated coal slurry, and the gas stream is thus purified. The subsequently reheated gas stream can then be admixed anew with the coal slurry to be heated.

Preferably, heating the gas stream is effected in the same furnace in parallel with heating the hydrogen used in the hydrogenizing process, so that no additional heat exchanger or furnace is required.

Basically, any suitable gas can be used for the gas stream. It is, however, preferable to use hydrogen because, in this case, any residual amount thereof remaining in the coal slurry would have a favorable effect on the hydrogenizing process. In addition, part of the heated hydrogenizing hydrogen can be tapped off and used as a hot gas stream.

More detailed explanations can be given on the basis of the constructional example illustrated in the appended FIGURE.

The FIGURE illustrates a process for hydrogenizing coal whereby, with the addition of a catalyst, finely ground coal is fed via a pipe-line 1, and grinding oil via a pipe-line 2 to a reservoir tank 3 where they are intimately mixed to form a slurry. By means of a pump 4, the slurry is fed, via a pipe-line 5 to a mixer 6.

Hot product vapors are drawn-off from the top of the hot separator 8 and likewise fed into the mixer 6 via a pipe-line 7.

In accordance with a first embodiment of the process, a hot gas stream is likewise fed into the mixer 6 via pipe-line 9.

In the mixer 6, the coal slurry is heated by direct heat exchange with the hot product vapors and the hot gas stream. The temperature and the mass flow of the hot gas stream are so chosen in the process that the coal slurry becomes heated to the hydrogenizing initiation temperature of about 430° C.

During the heat exchange in the mixer 6, gases and any water which may be contained in the coal, if such be the case, are driven out of the heating coal slurry while, on the other hand, part of the product vapors condenses and is fed back again, with the coal slurry, to be hydrogenated.

After being intimately mixed, the contents of the mixer 6 are fed into a separator 10 and separated into a gas phase and a solids-liquid phase.

The solids-liquid phase is pumped to a pressure of about 300 bars by means of the pump 11 and fed via a pipe-line 12 to a hydrogenizing reactor 13. Hydrogenizing hydrogen, which had been preheated in a furnace 15, is added via a pipe-line 14.

The gas phase in the separator 10 which, in addition to the gas stream, also contains the uncondensed product vapors along with the gases and vapors driven out of the coal slurry, is drawn off via a pipe-line 16 and passed through a heat exchanger 17. As a result of this interaction, the gas phase transfers its residual heat to the fresh hydrogen fed-in via a pipe-line 19, and also to the purified gas stream.

In a separation stage 18, from the gas stream are separated out both the entrained uncondensed product vapors and the gases and vapors driven out of the coal slurry and, after being purified in a scrubber 20, the gas stream is conveyed via a pipe-line 21 and via the heat exchanger 17 to the furnace 15 where it is heated again simultaneously with the hydrogenizing hydrogen and conducted again via the pipe-line 9 into the mixer 6.

In accordance with another procedure, the hot gas stream can be admixed, behind the mixer 6, via pipe-line **9*a*, in the separator 10 with the coal slurry after first separating-off the uncondensed product vapors and the gases and vapors driven out of the coal slurry and, after yielding up its heat to the coal slurry, the hot gas stream can be separated from the latter in an additional separator 22 drawn off via a pipe-line 23**. All the remaining steps in the process are unchanged.

In an especially simple and advantageous variant of the process, the hot gas stream is introduced via a pipe-line **9*b* directly into the sump of the separator 10 which is connected to the mixer 6, and admixed with the coal slurry. In the process, the hot gas stream passes through the coal slurry in counter-current so that a very intensive heat exchange and stripping effect is obtained. The gas stream is again drawn off at the top of the separator 10 via the pipe-line 16, together with the uncondensed product vapors and the gases and vapors driven out of the coal slurry, and then further treated in accordance with the procedure described above. As in the first-described process, the separator 22** can be dispensed with.

I claim:

1. An improved process for hydrogenizing coal whereby the finely ground coal is pumped under pressure, heated to the temperature at which hydrogenation is initiated and hydrogenated with hydrogen in a reaction zone in the presence of a substance which acts as a catalyst, the process being such that at least part of the heat required for the heating process is fed to the coal in a mixer by direct heat-exchange with hot product vapors, the improvement characterized in that, in the region of the mixer, the coal slurry is brought into contact with an additional hot stream of gas other than said hot product vapors and is heated by direct heat exchange contact therewith.

2. A process in accordance with claim 1, characterized in that the hot gas stream is admixed with the coal slurry in the mixer containing the product vapors and the coal slurry, or directly following it, and together with the part of the product vapors which was uncondensed during the heat exchange and the gases and vapors driven out of the heated coal slurry in the mixer, is separated again from the latter.

3. A process in accordance with claim 1, characterized in that the hot gas stream is admixed with the coal slurry following the mixer containing the hot product vapors and the coal slurry and after separating-off the uncondensed portion of the product vapors and the gases and vapors driven out of the coal slurry in the mixer, it is separated again from the latter together with the gases and vapors additionally driven out of the coal slurry.

4. A process in accordance with claim 1, characterized in that the hot gas stream is admixed with the coal slurry at the bottom of a separator which follows the mixer containing the hot product vapors and the coal slurry and, it is drawn off at the head of the separator, together with the uncondensed portion of the product vapors and the gases and vapors driven out of the heated coal slurry.

5. A process in accordance with claim 4, characterized in that the gas stream is separated from the product vapors and from the gases and vapors driven out of the coal slurry and purified and, after being reheated, the gas stream is admixed, at least partially renewed, to the coal slurry to be heated.

6. A process in accordance with claim 5, characterized in that the gas stream is heated parallel to heating the hydrogenizing hydrogen in the same furnace.

7. A process in accordance with claim 6, characterized in that the gas stream comprises predominantly hydrogen.

* * * * *